US005406662A

United States Patent [19]

Connor

[11] Patent Number: 5,406,662

[45] Date of Patent: Apr. 18, 1995

[54] APPARATUS FOR LAUNCHING INFLATABLE FASCINES

[75] Inventor: Richard C. Connor, Barton-on-Sea, United Kingdom

[73] Assignee: The Secretary of State for Defence in Her Britanic Majesty's Governement of the United Kingdom of Great Britain and Northern Ireland, London, England

[21] Appl. No.: 211,027

[22] PCT Filed: Sep. 9, 1992

[86] PCT No.: PCT/GB92/01642

§ 371 Date: Apr. 25, 1994

§ 102(e) Date: Apr. 25, 1994

[87] PCT Pub. No.: WO93/06305

PCT Pub. Date: Apr. 1, 1993

[30] Foreign Application Priority Data

Sep. 18, 1991 [GB] United Kingdom ..... 9119908

[51] Int. Cl.[6] ..... E01D 15/12; E01D 15/20

[52] U.S. Cl. ..... 14/2.5; 404/35; 404/83

[58] Field of Search ..... 404/15, 35, 72, 83; 14/77, 78, 2.4, 2.5, 2.6; 405/19

[56] References Cited

U.S. PATENT DOCUMENTS 4,566,821 1/1986 Knight et al. ..... 404/35

5,215,401 6/1993 Knight ..... 404/35

*Primary Examiner*—Ramon S. Britts

*Assistant Examiner*—James A. Lisehora

*Attorney, Agent, or Firm*—Nixon & Vanderhye

[57] ABSTRACT

Apparatus for launching inflatable fascines comprising a conveyor system to which uninflated fascines are attachable for delivery to a launching region and an inflator to effect inflation and launch of the fascines. The conveyor (2) comprises a number of rigid conveyor members (12), each of which constitutes a fascine support location. At each of the support locations a packaged fascine (24), comprising a deflated fascine (23) housed between a backing plate (25) and a frangible or hingeable containment member (26), is attachable. The packaged fascines (24) may also contain a reservoir of pressurized gas (32) for inflation purposes. The conveyor (2) is connected via drive wheels (9) to a motor (6) such that the support locations carrying the packaged fascines (24) are sequentially delivered to a fascine launching region (14).

19 Claims, 6 Drawing Sheets

APPARATUS FOR LAUNCHING INFLATABLE FASCINES

BACKGROUND OF THE INVENTION

The present invention relates to apparatus used for the launching of fascines and in particular to apparatus used for the launching of inflatable fascines.

Fascines are structures which are commonly used to enable vehicles and personnel to cross ditches and conventionally comprise bundles of elongate members. Recently fascines comprising bundles of plastic pipes have been employed an example of which is described in EP patent 0149314. A fascine which may be stored more compactly and which comprises a core of inflatable members surrounded by a necklace of rigid plastic pipes is described in UK patent 2242468. Fascines of the non inflatable kind are frequently used in military applications to enable tanks and other vehicles to cross ditches and when such an operation is to be performed under enemy fire there is a requirement for the deployment to be effected without exposing personnel. To this end tanks equipped with apparatus for the automatic launching of the fascines have been proposed. Due to the size of fascines required for military applications tank borne apparatus for the launching of the non inflatable type of fascine described in EP patent 0149314 is only able to carry and deploy a small number of fascines. UK patent 2242468 discloses apparatus which can carry and deploy more fascines because they have inflatable core members. Even so relatively frequent return to a safe area to re-stock with fresh fascines will be necessary which will severely inhibit the ability of a fascine deploying tank to keep up with the front line of an armoured advance.

SUMMARY OF THE INVENTION

It is the object of the invention to provide a fascine launching apparatus which overcomes the above mentioned disadvantages of the prior art fascine launching apparatus. It is a further object of the invention to provide a fascine launching apparatus which will have a relatively low profile when used and which displays reduced variability between successive launching operations.

Thus according to the invention there is provided apparatus for deploying inflatable fascines comprising a movable conveyor defining a plurality of fascine support locations a conveyor support structure, drive means adapted to move the conveyor with respect to the support structure in order to sequentially bring the fascine support locations to a fascine launching region, inflation actuation means for initiating fascine inflation at the fascine launching region and fascine release actuation means for causing release of a fascine from the apparatus.

Fascine launching equipment constructed according to the invention will be capable of sequentially delivering uninflated fascines having a low profile to a fascine launching region, inflating the fascines and then launching them. As each inflated fascine will be launched from a single fascine launching region the variability of sequential fascine launches will be reduced and the directional control of the launching process will be made more predictable. Detrimental raising of the centre of gravity Of a vehicle equipped with the apparatus will be kept to a minimum thus improving stability and cross-country mobility. The delivery of the fascines to the fascine launching region in a low profile unitflared state will reduce the chance of enemy detection. Furthermore providing apparatus which moves fascines to be deployed to a fascine launching region by means of a conveyor enables the apparatus to handle more fascines than have hitherto been handleable by prior art fascine launching apparatus and rapidly launch consecutive fascines where there is a requirement to place more than one fascine in a given ditch.

As the fascines to be launched by the conveyor are inflatable and are likely to need support prior to and possibly during inflation the conveyor conveniently comprises a continuous loop of articulated rigid members which constitute the fascine support locations.

In order to facilitate automatic operation of the apparatus and to reduce the possibility of foreign objects jamming the fascine inflation actuation means the actuation means is preferably electrical and more preferably comprises an electrical contact associated with each fascine support location which is registrable with a source of electrical power when each fascine support location occupies the fascine launching region.

In order to facilitate automatic operation of the apparatus still further the apparatus preferably comprises stop means for automatically halting the conveyor when a fascine support location arrives at the fascine launching region.

As launching of a fascine will normally be succeeded by movement of a further fascine into the fascine launching region preferably fascine release is effected by forward movement of the conveyor. As the conveyor will be moving in close proximity to the support structure such a release actuation may conveniently be performed by the camming action of a surface fixed to the support structure The invention also provides a fascine launching apparatus in combination with one or more uninflated packaged fascines the or each of which is connected to the conveyor at a fascine support location.

In order to reduce the number of commands required to operate the apparatus remotely the packaging associated with each fascine preferably includes at least one containment member which is releasable by partial inflation of the fascine so as to allow full inflation of the fascine. In this way a separate command relating to partial release of the fascine to allow full inflation to take place is not required. The containment member is preferably frangibly or hingeably connected to the remainder of the packaging.

Suitable materials for making the fascines out of include reinforced polyurethane, polyethylene, polyetherurethane, polyesterurethane or polyvinylchloride material. Such materials are rugged enough for the application and are capable of being joined to form seams using adhesive bonding, thermal bonding or radio frequency welding techniques.

In order to facilitate connection of fascines to the apparatus, release of fascines from the apparatus, topping up pressure in a fascine when in situ and replacing fascine inflation reruns when a fascine is in situ each packaged fascine preferably includes at least one reservoir of pressurised gas for fascine inflation purposes. The gas reservoirs will preferably be rechargeable. The inflation means may alternatively include chemical gas generation means.

As gas leakage from the fascine may occur when a fascine is left in situ for a long period or if the fascine becomes punctured each reservoir of pressurised gas is preferably connected to its associated fascine via pressure control means which act to regulate gas supply to the fascine so as to maintain pressure in the fascine at a substantially constant pressure.

BRIEF DESCRIPTION OF THE DRAWINGS

The invention will now be described by way of example only with reference the accompanying drawings in which.

DESCRIPTION OF THE PREFERRED EMBODIMENTS

Figure 1:
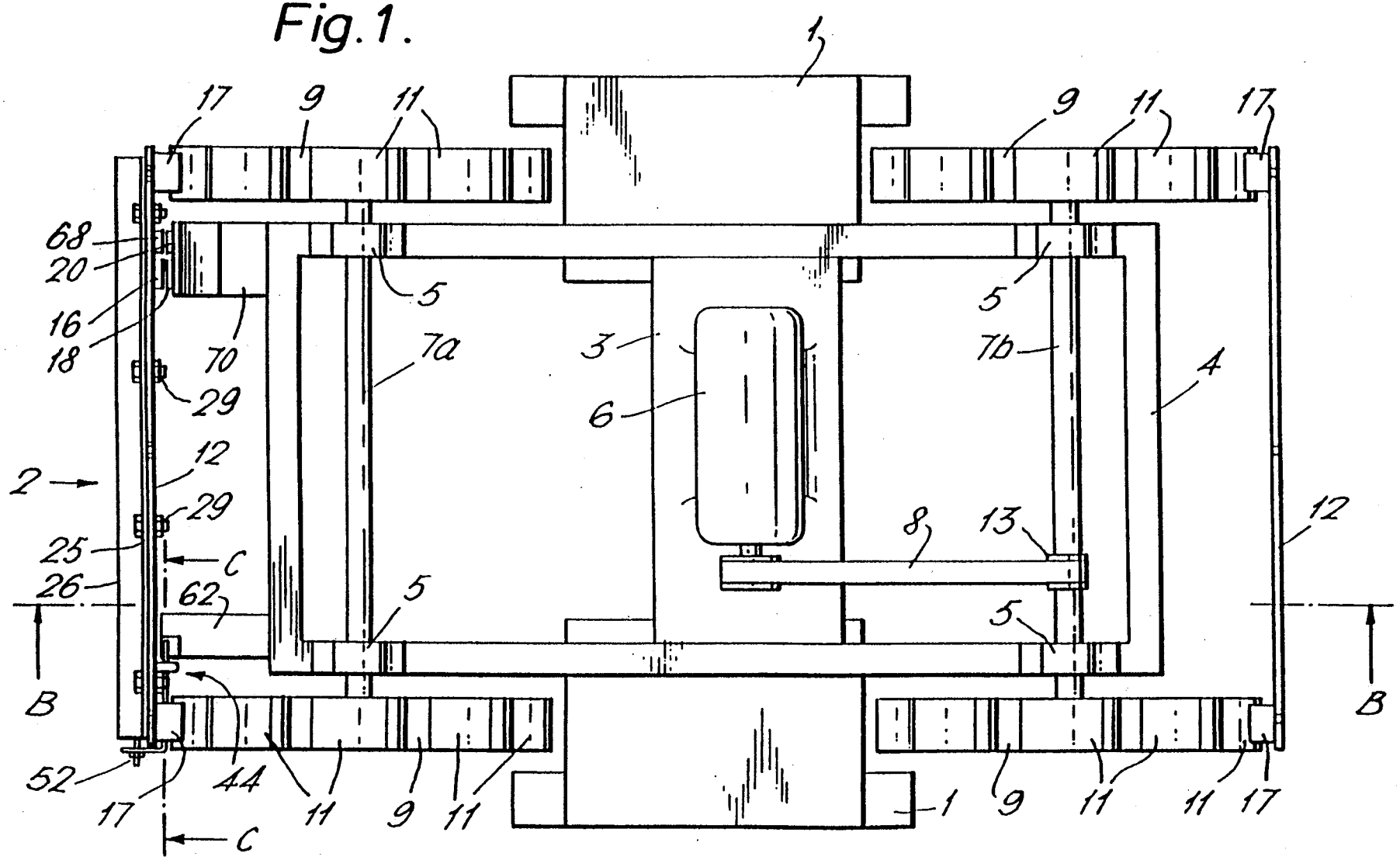
FIG. 1 Is a plan view from above of a fascine launching apparatus according to the invention with upper and lower conveyor members removed.
Figure 2:
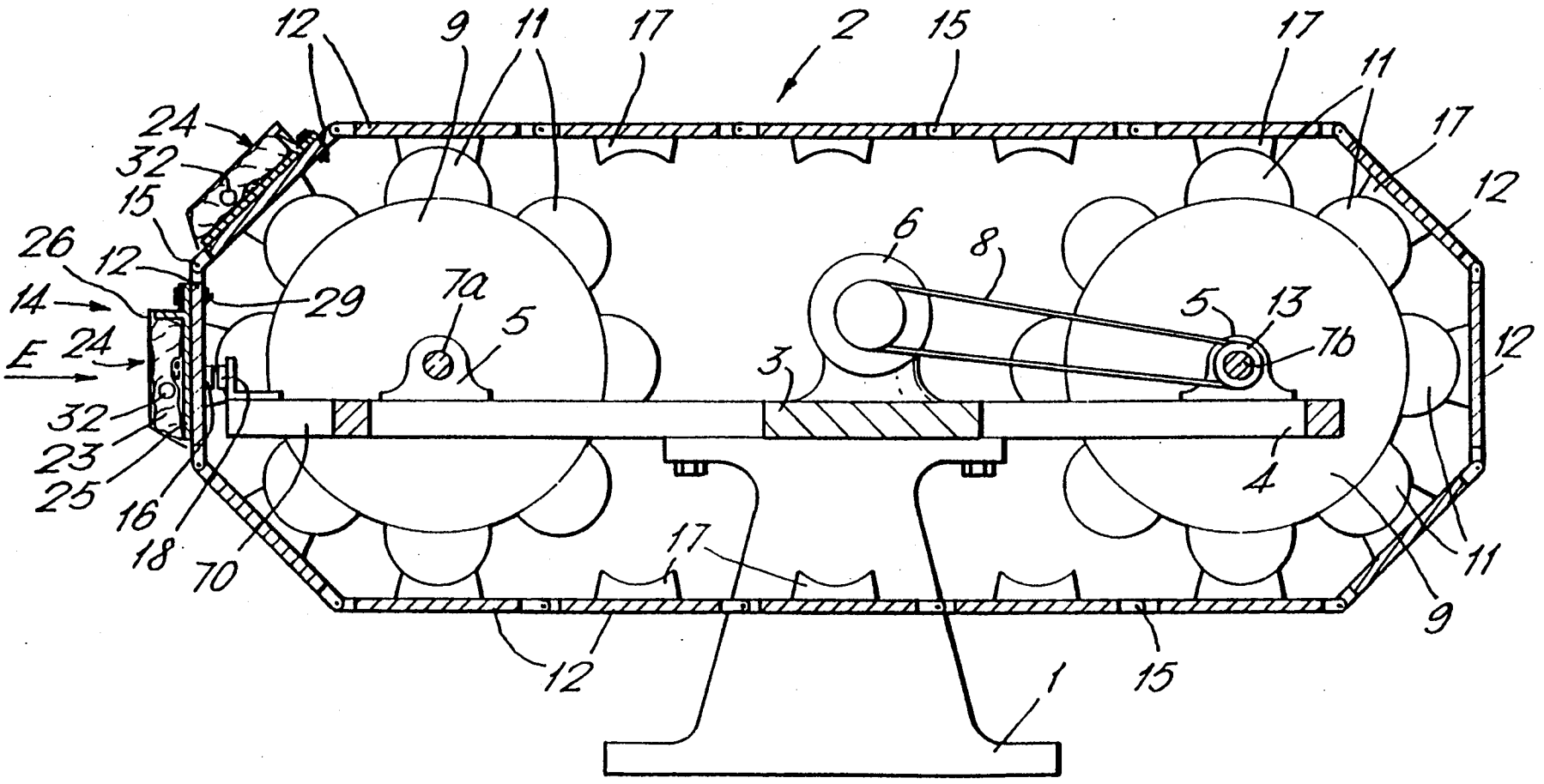
FIG. 2 Is a vertical cross section on the line B—B of the apparatus shown in FIG. 1 (all conveyor members and two packaged fascines are shown).

A fascine launching apparatus according to the invention is shown generally at FIGS. 1 and 2. The apparatus is adapted to be mounted on the top of a vehicle such as a tank by means of stands 1 which are connected to either side of the apparatus. The apparatus includes a horizontal conveyor support structure 4 which is in the form of a rectangular frame. Near the front of the support structure 4 two bearing supports 5 are located which serve to rotatably support a transverse shaft *7a*. Similar bearing supports 5 near the rear of the support structure rotatably support a further transverse shaft *7b*. The ends of each shaft *7a* and *7b* extend outwardly beyond the bearing supports 5 and are connected to drive wheels 9. Each drive wheel 9 is provided with eight equally spaced conveyor engaging lobes 11. A cross member 3 which extends across the support structure 4 bears an electric motor 6 which constitutes the drive means for a conveyor 2. A flexible belt 8 connects the electric motor to a pulley 13 on the rearmost shaft *7b*.

Passing round the outside of the drive wheels 9 is a continuous conveyor 2 which is constituted by sixteen rigid conveyor member 12 which are interconnected by pivot pins 15 (the upper and lower conveyor members have been removed from the plan view in FIG. 1 for clarity). At each end of the inner surface of each conveyor member a lobe engaging protrusion 17 is provided which has a curved surface designed to engage the lobes 11 on the drive wheels 9.

Figure 4:
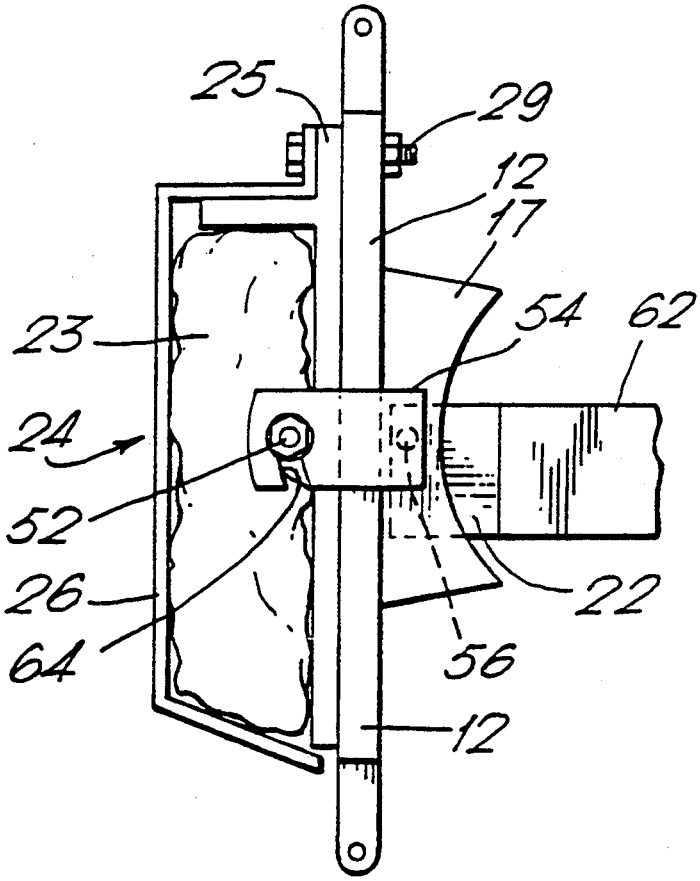
FIG. 4 Is an end elevation of the conveyor member shown in FIG. 3 (in the direction of the arrow D) and shows a packaged fascine.
Figure 5:
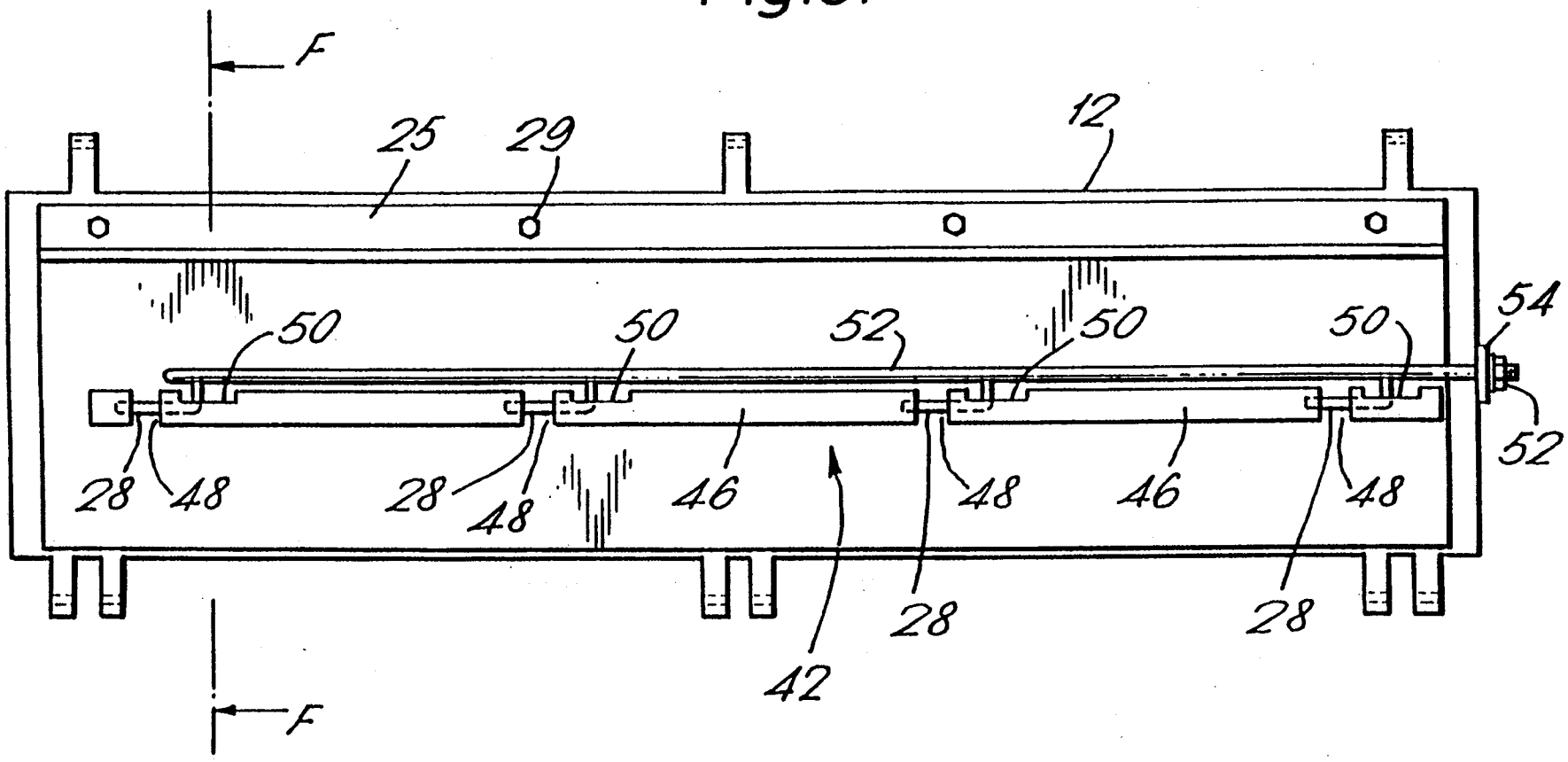
FIG. 5 Is a vertical elevation of the conveyor member shown in FIG. 2 (in the direction of arrow E) with the frangible cover and fascine removed to reveal the fascine release mechanism.
Figure 6:
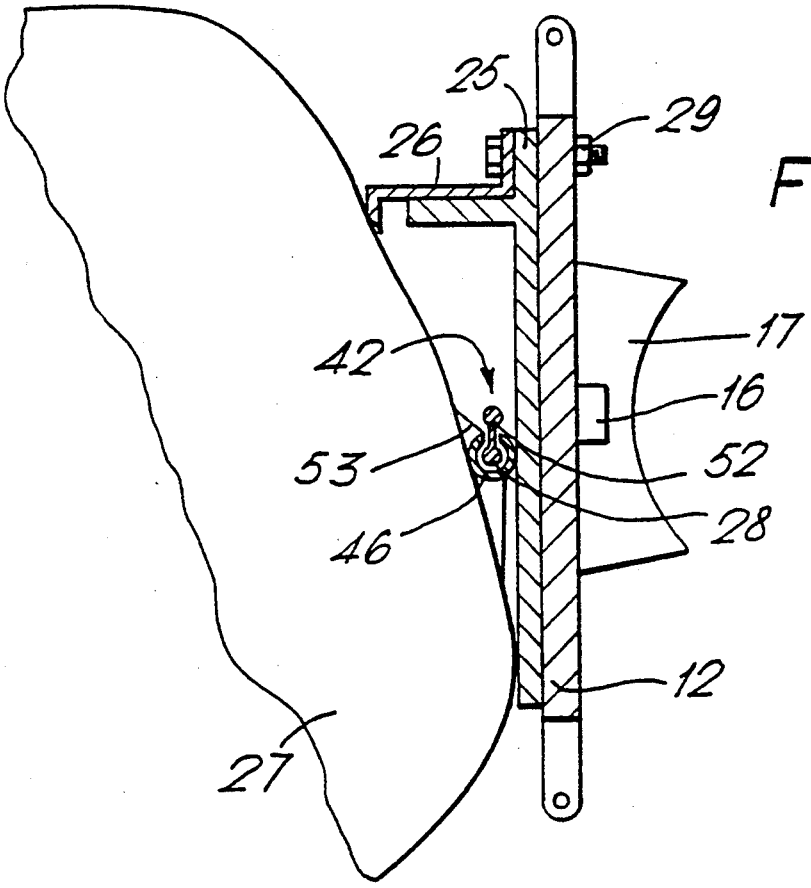
FIG. 6 Is a vertical cross section on the line F—F of the conveyor member shown in FIG. 5 supporting an inflated fascine ready for release.
Figure 7:
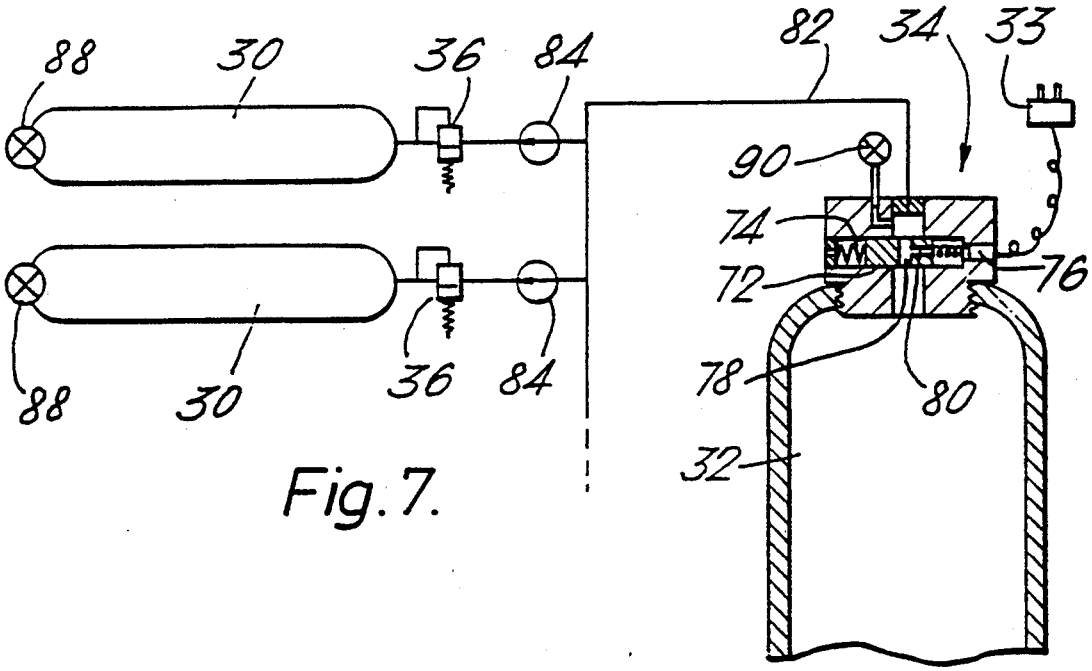
FIG. 7 Is a schematic representation of the fascine inflation means.

Each conveyor member 12 constitutes a fascine support location to which a packaged fascine 24 is connectable. Two such packaged fascines are shown in FIG. 2 one of which is located in a fascine launching region 14. An enlarged end view of an isolated conveyor member 12 with a packaged fascine 24 connected to it is shown in FIG. 4. A deflated fascine 23 is housed between a backing plate 25 and a frangible containment member 26. The backing plate 25 and the containment member 26 are held together by bolts 29 which also act to hold the packaged fascine to a conveyor member 12. A pinned connection may be used instead of the bolts 29. Additional securing means which are not shown are also provided for securing the containment member to the backing plate when the packaged fascine is not mounted on the conveyor member. With each packaged fascine a reservoir of pressurised gas 32 is provided (see FIGS. 2 and 7) which is connected to the uninflated fascine 23 for inflation purposes as shown in FIG. 7. A fascine engagement mechanism 42 extends along each backing plate as shown in FIGS. 5 and 6.

Figure 3:
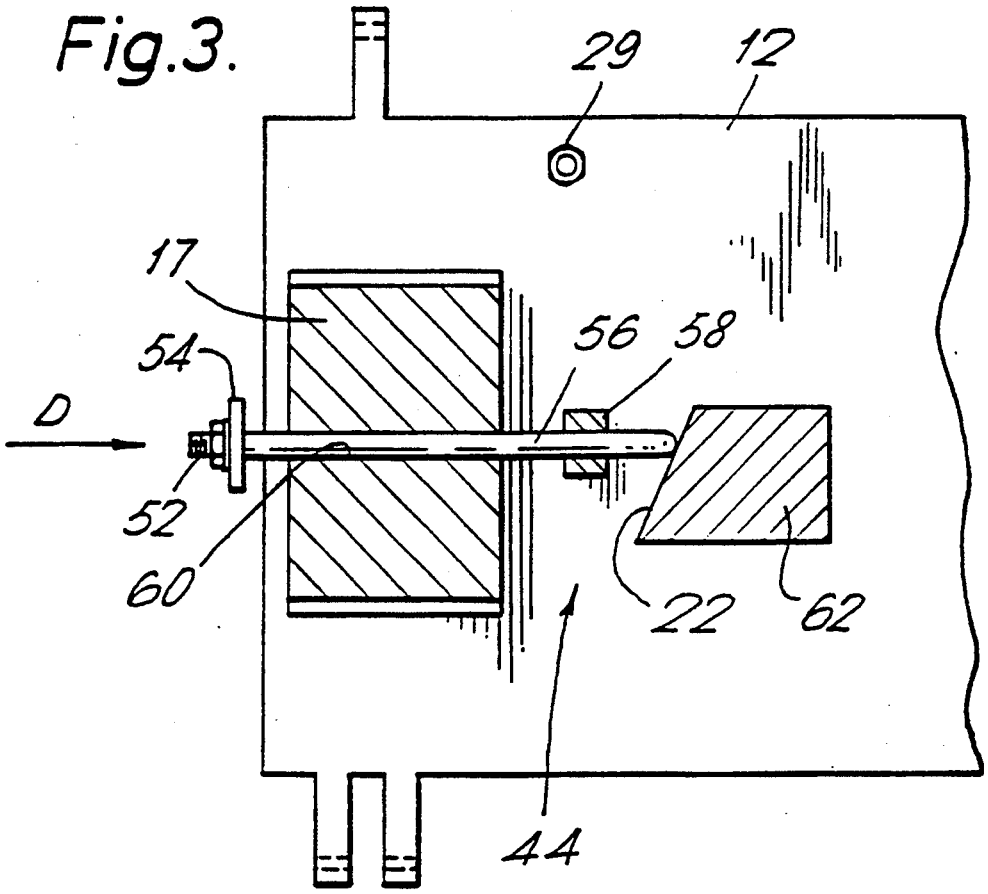
FIG. 3 Is a vertical section on the line C—C of FIG. 1 and shows one end of a conveyor member and the fascine release actuation means.

The fascine engagement mechanism 42 is used to retain a fascine while it is being inflated and is releasable by means of a fascine release actuation mechanism which is shown generally in FIG. 3 in order to enable the release of a fascine once it has been inflated. The fascine engagement mechanism comprises a tube 46 containing gaps 48 for allowing fascine straps 53 to be engaged by sliding bolts 28 which constitute the fascine engaging members and are slideable in the tube 46. Each sliding bolt 28 is connected through a slot 50 in the tube 46 to an single actuating rod 52 which runs the length of the backing plate 25 and protrudes past one end of the backing plate 25 for connection to the fascine release actuation mechanism 44.

The fascine release actuation mechanism is illustrated in FIG. 3 and includes a camming rod 56 which is slideably mounted in a bore 60 in the lobe engaging protrusion 17 at one end of the conveyor member 12. One end of the camming rod 56 which extends past the end of the backing plate 12 is connected to a plate 54 which is provided with an arcuate slot 64 for engaging the actuating rod 52. The opposite end of the camming rod 56 passes through a camming rod guide 58 connected to the rear of the associated conveyor member and is located so that the end of the camming rod is slideable over a camming surface 22 of a camming block 62 which is rigidly connected to the conveyor support structure 4 (not shown in FIG. 3).

At the opposite end of each conveyor member to that at which the release actuation mechanism 44 is located a magnet 68 and an electrical contact 16 are provided (see FIG. 1). The magnet 68 is positioned such that when the conveyor member arrives at the fascine launching region 14 it trips a proximity switch 20 which is rigidly connected to the support structure 4 and which is electrically connected to an electronic apparatus control device (not shown). The electrical contact 16 is electrically connected to an inflation valve 34 mounted on the compressed gas reservoir 32 via an easily connectable plug 33 which may be plugged in when a packaged fascine 24 is mounted onto a conveyor member 12. The electrical contact 16 is positioned such that when the conveyor member arrives at the fascine launching region 14 it comes into contact with a source of electrical power 18. Both the proximity switch 20 and the source of electrical power 18 are connected to the support structure 4 by means of an extension member 70.

Each packaged fascine is supplied with an inflation system which is shown schematically in FIG. 7. The system includes a reservoir of pressurised gas 32 which is connected via an inflation valve 34, a flexible pipe 82, a one way valve 84 and a pressure control valve 36 to each-inflatable cell 30 of the fascine 23. The inflation valve 34 includes a sliding valve member 72 containing a main passage 78 for allowing gas to pass from the reservoir 32 into the pipe 82 and a side passage 80 which permits gas in the maim passage 78 to communicate with one end of the valve member 72. The valve member 72 is biased to the right as viewed in FIG. 7 by a spring 74 and is biasable in the opposite direction by a solenoid 76.

Figure 8:
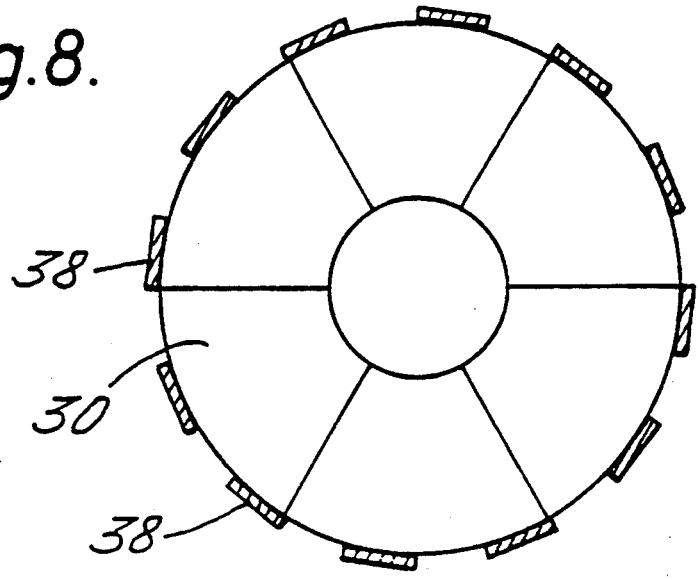
FIG. 8 Is a schematic vertical cross section of one type of fascine which could be launched from the apparatus shown in FIGS. 1 to 6.
Figure 9:
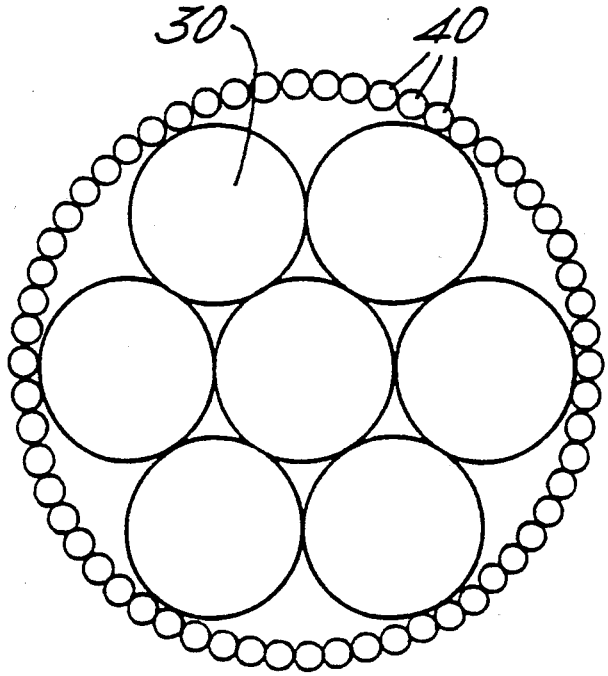
FIG. 9 Is a schematic vertical cross section of an alternative type of fascine which could be launched from the apparatus shown in FIGS. 1 to 6.

Each fascine may be constituted by a single bag as shown in FIG. 6 but is preferably constituted by a number of inflatable cells 30 as shown in FIGS. 8 and 9. Suitable materials for the manufacture of the fascines include reinforced polyurethane, reinforced polyetherurethane, reinforced polyesterurethane or reinforced polyvinylchloride. Suitable material for the reinforcement of the polymer material include Kevlar (RTM), Nylon (RTM), Spectra (RTM) and Dyneema (RTM) fabric. The outer surface of each fascine may be provided with rigid members such as the plate like members 38 shown in FIG. 8 or tubular members 40 such as those shown in FIG. 9 where the intended use of the fascine calls for extra protection. The bulky nature of these rigid members however means that the volume into which the uninflated fascine can be packed will be significantly increased and for this reason their inclusion is normally avoided.

The operation of the fascine launching apparatus will now be described with reference to FIGS. 1 to 7.

On receipt of an electrical signal by the electronic apparatus control device (not shown) from an operator indicating that there is a requirement to launch a fascine electrical current is supplied to the electric motor 6. Drive from the motor 6 is conveyed to the shaft **7*b* (in an anti clockwise direction as viewed in FIGS. 1 and 2) by means of the flexible belt 8 and the pulley 13. Rotation of the shaft 7*b* causes the drive wheels 9 located at each end of the shaft to rotate. Due to the fact that the conveyor members are engaged with the drive wheels by means of lobe engaging protrusions 17 the conveyor 2** is also circulated in an anti clockwise direction.

When a packaged fascine 24 arrives at the fascine launching region 14 the magnet 68 connected to the rear of the associated conveyor member comes into register with the proximity switch 20 mounted on the extension member 70 of the support structure. The tripping of the proximity switch results in an electrical signal being sent to the control device which causes electrical current supply to the electric motor 6 to be stopped which causes the conveyor 2 to halt. As this is occurring the electrical contact 16 which is also mounted on the rear of the conveyor member 12 comes into contact with the source of electrical power 18. Current from the contact 16 passes via the plug 33 (see FIG. 7) to the inflation valve 34 connected to the reservoir of compressed gas 32. The current energises solenoid 76 and forces the sliding valve member 72 to the left (as viewed in FIG. 7) against the biasing effect of the spring 74. When gas in the reservoir 32 can enter the main passage 78 in the valve member 72 gas also flows along side passage 80 into a sealed chamber containing the solenoid 76 and is thus able to bear on the right hand end of the valve member 72. Due to the fact that the chamber containing the spring 74 is vented to the atmosphere the differential pressure on the valve member 72 forces the valve into the fully open position shown in FIG. 7. Due to the fact that the inflation valve 34 is held open by the pressure of gas in the reservoir once the valve has been opened the inflation valve will remain open even after the plug 33 has been disconnected by the launching of the fascine and no further current is being supplied to the solenoid. Gas then flows along the pipe 82 and passes through one way valves 84 and pressure control valves 36 into individual inflatable cells 30 of the packaged fascine 24. The pressure control valves are designed so that when the pressure in a particular cell reaches a required level the valve closes but when the pressure falls below this threshold the valve is forced open under the action of a spring and allows gas from the reservoir 32 to enter the cell. In this way if a slow leak develops in a fascine which is in situ then the pressure will be topped up to the required level by gas from the reservoir provided that the reservoir 32 has not been exhausted. The one way valves 84 will ensure that in the event of the reservoir becoming exhausted and a leak developing in one of the cells 30 only the cell having the leak will become deflated.

As the packaged fascine 24 starts to inflate the outer surface of the frangible containment member 26 breaks off leaving only the part shown in FIG. 6. A hingeable containment member may alternatively be provided which includes a hinge located at the point of the break in member 26 shown in FIG. 6 which allows the containment member to hingeably open. During inflation the fascine is held to the backing plate 25 by four straps 53 which are connected to the outer surface of the fascine 27 and each of which passes round a sliding bolt 28.

When the operator is satisfied that the fascine to be launched is fully inflated he sends a further electrical signal to the control device (not shown) which causes the electric motor 6 to advance the conveyor a small distance in the anti clockwise direction. As this occurs the camming rod 56 associated with the conveyor member situated in the fascine launching region 14 slides down the camming surface 22 of the camming block 62. The effect of this camming action is that the camming rod 56, plate 54 and actuating rod 52 are moved to the left as viewed in FIG. 3, and to the right as viewed in FIG. 5. The sliding bolts are retracted into the tube 46 thus releasing the straps 53 and allowing the inflated fascine 27 to be launched. As this occurs the plug 33 which is connected to the fascine is disconnected from the conveyor member 12.

As described above when the fascine is inflated and in situ the inflation valve will remain open and the pressure control valves 36 will ensure that the pressure in each cell is maintained at a particular threshold value. If the reservoir of compressed gas 32 becomes exhausted then the reservoir can be recharged from an external source via refill valve 90. When there is a requirement to deflate the fascine the dump valves 88 can be manually opened. If a gas other than air such as carbon dioxide, nitrogen or helium has been used to inflate the fascine then apparatus may be provided for collecting the gas as the fascine is deflated so that it can be reused.

The dump valves 80 may also be used for inflation of the fascine from a compressor or vehicle exhaust system in the event of the inflation system described above failing to operate correctly.

As an alternative to the reservoir of compressed gas being packaged and launched with a fascine each conveyor member may be equipped with a reservoir which is connected to its associated fascine by means of a coupling which is disconnectable by the action of releasing the fascine from the conveyor leaving the reservoir connected to the conveyor. In this way the fascines may be packaged more compactly and need not be stored with a relatively inaccessible reservoir of compressed gas. This may be an advantage if the fascines are likely to be stored for long periods of time. A further alternative to the provision of a reservoir of compressed gas is to provide chemical gas generation means which may be either packaged with the fascine or permanently connected to the conveyor as described above. The advantage of a chemical gas generating means is that the volume and weight of the source of pressurised gas can be significantly reduced.

I claim:

1. Apparatus for deploying inflatable fascines characterised in that it comprises a movable conveyor (2) defining a plurality of fascine support locations, a conveyor support structure (4), drive means adapted to move the conveyor with respect to the support structure in order to sequentially bring the fascine support locations to a fascine launching region (14), inflation actuation means for initiating fascine inflation at the fascine launching region and fascine release actuation means for causing release of a fascine from the apparatus.

2. Apparatus as claimed in claim 1 wherein the conveyor is constituted by a continuous loop of articulated rigid members (12) which constitute the fascine support locations.

3. Apparatus as claimed in claim 1 wherein the fascine inflation actuation means is electrical.

4. Apparatus as claimed in claim 3 wherein the inflation actuation means comprises an electrical contact (16) associated with each fascine support location which is registrable with a source of electrical power (18) when each fascine support location occupies the fascine launching region (14).

5. Apparatus as claimed in claim 1 further comprising stop means for automatically halting the conveyor when a fascine support location arrives at the fascine launching region.

6. Apparatus as claimed in claim 1 wherein fascine release is effected by forward movement of the conveyor (2).

7. Apparatus as claimed in claim 6 wherein the fascine release actuation means comprises a camming surface (22) fixed to the support structure (4).

8. Apparatus as claimed in claim 1 further including one or more unitflared packaged fascines (24) having packaging which is connected to the conveyor (2) at a fascine support location.

9. Apparatus as claimed in claim 8 wherein said packaging includes at least one containment member (26) which is releasable by partial inflation of the fascine (23) so as to allow full inflation of the fascine.

10. Apparatus as claimed in claim 9 wherein the containment member (26) is frangibly connected to a remainder of the packaging.

11. Apparatus as claimed in claim 9 wherein the containment member (26) is hingeably connected to the remainder of the packaging.

12. Apparatus as claimed in claim 8 further comprising one or more fascine engaging members (28) associated with each fascine support location which act to retain a fascine at the fascine support location during inflation but are disengageable under the action of the fascine release actuation means (44) so as to allow the fascine to be released from the apparatus.

13. Apparatus as claimed in claim 8 wherein each fascine (23) includes a plurality of inflatable cells (30).

14. Apparatus as claimed in claim 8 wherein each fascine comprises one or more inflatable cells made from reinforced polyurethane, polyethylene, polyetherurethane, polyesterurethane or polyvinylchloride material.

15. Apparatus as claimed in claim 8 wherein each packaged fascine includes at least one reservoir of pressurised gas (32) for fascine inflation purposes.

16. Apparatus as claimed in claim 15 wherein each reservoir of pressurised gas (32) is isolatable from its associated fascine (23) by means of a valve (34) which is openable by the fascine inflation actuation means and remains open after the fascine has been released from the apparatus.

17. Apparatus as claimed in claim 15 wherein each reservoir of pressurised gas (32) is connected to its associated fascine via pressure control means (36) which act to regulate gas supply to the fascine (23) so as to maintain pressure in the fascine at a substantially constant pressure.

18. Apparatus as claimed in claim 1 wherein each fascine support location is provided with a reservoir of pressurised gas for fascine inflation purposes which reservoir remains connected to the conveyor after a fascine has been released from that fascine support location.

19. Apparatus as claimed claim 8 wherein each fascine includes rigid members (38,40) located on an exterior surface of the fascine.

* * * * *